United States Patent [19]

Hoke

[11] 4,400,178

[45] Aug. 23, 1983

[54] LIQUID FUELS CONTAINING POLYAMINE DISPERSANTS

[75] Inventor: Donald I. Hoke, Chagrin Falls, Ohio

[73] Assignee: The Lubrizol Corporation, Wickliffe, Ohio

[21] Appl. No.: 301,844

[22] Filed: Sep. 14, 1981

Related U.S. Application Data

[62] Continuation of Ser. No. 142,316, Apr. 21, 1980, aban doned.

[51] Int. Cl.[3] ..... C10L 1/22

[52] U.S. Cl. ..... 44/72; 44/63; 44/77

[58] Field of Search ..... 44/63, 66, 72, 77

[56] References Cited

U.S. PATENT DOCUMENTS

| | | | |
|---|---|---|---|
| 2,891,850 | 6/1959 | Cosgrove | 44/72 |
| 3,640,855 | 2/1972 | Bakker | 252/32.7 |
| 3,960,515 | 6/1976 | Honnen | 44/72 |

*Primary Examiner*—Jacqueline V. Howard

*Attorney, Agent, or Firm*—James W. Adams, Jr.; Roger Y. K. Hsu; Raymond F. Keller

[57] ABSTRACT

Certain polyamines are useful carburetor dispersants for liquid fuel compositions. Among the suitable polyamines are diamines which may be prepared by the Mannich reaction of certain primary or secondary amines with an aldehyde such as formaldehyde and an aliphatic nitro compound such as 2-nitropropane, followed by reduction of the nitro group.

12 Claims, No Drawings

LIQUID FUELS CONTAINING POLYAMINE DISPERSANTS

This application is a continuation of copending application Ser. No. 142,316, filed Apr. 21, 1980, now abandoned.

This invention relates to novel liquid fuels having improved properties. In its broadest sense, the invention is directed to fuel compositions comprising a major amount of a normally liquid fuel and a minor amount of at least one polyamine of the formula

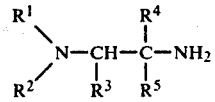

wherein:

$R^1$ is an aliphatic hydrocarbon-based radical;

$R^2$ is hydrogen or an aliphatic hydrocarbon-based radical;

$R^3$ is hydrogen or a lower hydrocarbon-based radical;

$R^4$ is hydrogen or an alkyl-based radical; and $R^5$ is an alkyl-based radical.

It is well known that internal combustion engine fuels such as gasoline tend to deposit sludge and varnish in the carburetor. It has been of interest, therefore, to develop fuel compositions with decreased tendency to form such deposits.

A principal object of the present invention, therefore, is to provide novel fuel compositions with improved properties.

A further object is to provide fuel compositions with a decreased tendency to form deposits in carburetors.

Still another object is to provide fuel compositions containing a unique dispersant additive system which decreases the tendency of the fuel to leave such deposits.

Other objects will in part be obvious and will in part appear hereinafter.

The normally liquid fuel comprising the major proportion of the compositions of this invention is usually a hydrocarbonaceous petroleum distillate fuel such as motor gasoline as defined by ASTM Specification D439, or diesel fuel or fuel oil as defined by ASTM Specification D396. Normally liquid fuel compositions comprising non-hydrocarbonaceous materials such as alcohols, ethers, organonitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of gasoline and ethanol and of diesel fuel and ether. Particularly preferred is gasoline, that is, a mixture of hydrocarbons having an ASTM boiling point of about 60° C. at the 10% distillation point to about 205° C. at the 90% distillation point.

The second essential ingredient in the fuel compositions of this invention is a polyamine having the above formula. The term "hydrocarbon-based radical", used in the definitions of certain values in that formula, denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like. Such radicals are known to those skilled in the art; examples include methyl, ethyl, propyl, butyl, octyl, decyl, dodecyl, octadecyl, cyclohexyl, phenyl, tolyl and benzyl.

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents (e.g., hydroxy, alkoxy, nitro, carbalkoxy).

(3) Hetero radicals, that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

Terms such as "aliphatic hydrocarbon-based radical" and "alkyl-based radicals" have analogous meanings with respect to aliphatic and alkyl radicals and the like.

In the formula, $R^1$ is an aliphatic hydrocarbon-based radical which is preferably free from acetylenic unsaturation and which is usually a hydrocarbon radical. $R^2$ may be hydrogen or may be a radical similar or identical to $R^1$. Usually, $R^1$ and $R^2$ together will contain at least about 10 and preferably about 15–50 carbon atoms. Included within the scope of the invention are mixtures of polyamines wherein $R^1$ and/or $R^2$ contain 16–18 carbon atoms and are derived from tallow fatty acids, coconut fatty acids, soya fatty acids or the like. Also within the scope of the invention are compounds in which $R^1$ and $R^2$, together with the nitrogen atom to which they are attached, form a heterocyclic radical.

The $R^3$ radical is usually hydrogen but may be a lower hydrocarbon-based radical and especially a lower hydrocarbon radical, the word "lower" denoting radicals containing up to 7 carbon atoms. $R^4$ and $R^5$ are usually alkyl-based and especially alkyl radicals, although $R^4$ may be hydrogen; most often, each of $R^4$ and $R^5$ is a lower alkyl radical and preferably methyl.

Two classes of diamines are especially preferred for use in the compositions of this invention. In the first class, $R^2$ is hydrogen and $R^1$ is $R^6O$-$R^7$— wherein $R^6$ is an alkyl and $R^7$ an alkylene radical, and $R^6$ and $R^7$ together contain about 10–25 carbon atoms. Most often, $R^6$ contains about 8–20 and $R^7$ about 2–6 carbon atoms. In the second class, $R^1$ is an alkyl radical containing about 10–25 carbon atoms and $R^2$ is either hydrogen or an alkyl radical containing about 10–25 carbon atoms. The most readily available compounds in each of these classes are those in which $R^3$ is hydrogen and each of $R^4$ and $R^5$ is methyl. Such compounds, and homologs thereof, may be prepared by a two-step procedure in which the first step is a Mannich reaction of an aliphatic nitro compound (especially 2-nitropropane) with an aldehyde (especially formaldehyde) and an amine of the formula

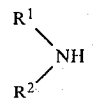

and the second step is the reduction (e.g., by hydrogenation) of the nitro group in the nitro amine thus obtained. A number of suitable amines are available from Armak Company.

The following table lists illustrative diamines which may be used in the fuel compositions of this invention. In each of these, $R^3$ is hydrogen and $R^4$ and $R^5$ are each methyl.

| Example | $R^1$ | $R^2$ |
|---|---|---|
| 1 | $C_{13}H_{27}O(CH_2)_3$ | H |
| 2 | Tallow | H |
| 3 | Tallow | Tallow |
| 4 | $C_{18}H_{37}$ | $CH_3$ |
| 5 | 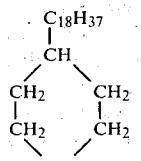 | |

The fuel compositions of this invention contain an amount of the polyamine sufficient to disperse insoluble impurities and inhibit deposit formation; usually this amount is about 5–1000, preferably about 10–100, parts by weight of polyamine per million parts by weight of fuel.

The fuel compositions of this invention can contain, in addition to the polyamines, other additives which are well known to those of skill in the art. These can include anti-knock agents such as tetra-alkyl lead compounds, lead scavengers such as haloalkanes (e.g., ethylene dichloride and ethylene dibromide), auxiliary deposit preventors or modifiers such as triaryl phosphates, dyes, cetane improvers, antioxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents and the like.

The polyamine can be added directly to the fuel to form the fuel compositions of this invention or it can be diluted with a substantially inert, normally liquid organic diluent such as mineral oil, xylene, or a normally liquid fuel as described above, to form an additive concentrate which is then added to the fuel in sufficient amounts to form the fuel composition. These concentrates generally contain about 20–90 percent of the polyamine and can contain in addition any of the above-described conventional additives, the remainder being diluent.

Illustrative of the fuel compositions of this invention are gasolines containing 24 parts per million of the polyamine of Example 1, 2 or 3.

What is claimed is:

1. A fuel composition comprising a major amount of a normally liquid fuel and a minor amount of at least one polyamine of the formula

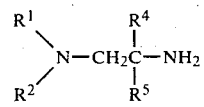

wherein:

$R^1$ is an aliphatic hydrocarbon-based radical free from acetylenic unsaturation and containing 16–18 carbon atoms;

$R^2$ is hydrogen or an aliphatic hydrocarbon-based radical free from acetylenic unsaturation and containing 16–18 carbon atoms; and each of $R^4$ and $R^5$ is a lower alkyl radical.

2. A composition according to claim 1 wherein $R^1$ is $R^6O\text{-}R^7$—, $R^2$ is hydrogen, $R^6$ is an alkyl radical, and $R^7$ is an alkylene radical containing about 2–6 carbon atoms.

3. A composition according to claim 2 wherein each of $R^4$ and $R^5$ is methyl.

4. A composition according to claim 3 wherein $R^6$ is tridecyl and $R^7$ is trimethylene.

5. A composition according to claim 1 wherein $R^1$ is an alkyl radical.

6. A composition according to claim 5 wherein $R^2$ is hydrogen.

7. A composition according to claim 6 wherein each of $R^4$ and $R^5$ is methyl.

8. A composition according to claim 7 wherein $R^1$ is derived from tallow fatty acids.

9. A composition according to claim 5 wherein $R^2$ is an alkyl radical.

10. A composition according to claim 9 wherein each of $R^4$ and $R^5$ is methyl.

11. A composition according to claim 10 wherein $R^1$ and $R^2$ are derived from tallow fatty acids.

12. A composition according to any of claims 1 and 2–11 wherein the fuel is gasoline.

* * * * *